United States Patent [19]

Rhodes

[11] Patent Number: 4,697,306

[45] Date of Patent: Oct. 6, 1987

[54] SELF-CLOSING CHILD-PROOF HINGE/LOCK MECHANISM

[76] Inventor: Bernard J. Rhodes, 21 Keera Street, Coorparoo, Brisbane, Queensland, 4151, Australia

[21] Appl. No.: 756,040

[22] Filed: Jul. 17, 1985

Related U.S. Application Data

[63] Continuation-in-part of Ser. No. 508,154, Jun. 24, 1983, abandoned.

[30] Foreign Application Priority Data

Jul. 17, 1984 [AU] Australia ..... PG6044

[51] Int. Cl.[4] ..... E05F 1/04

[52] U.S. Cl. ..... 16/317; 16/347; 16/360; 16/363; 256/26

[58] Field of Search ..... 16/266, 271, 272, 312, 16/315, 316, 317, 318, 341, 342, 343, 345, 347, 351, 353, 360, 363; 256/26

[56] References Cited

U.S. PATENT DOCUMENTS

| | | | |
|---|---|---|---|
| 156,325 | 10/1874 | Alston | 16/317 |
| 182,570 | 9/1876 | Ferguson | 16/343 |
| 309,039 | 12/1884 | Foster | 16/316 |
| 530,377 | 12/1894 | Ashton | 16/351 |
| 612,471 | 8/1898 | Wood | 16/318 |
| 753,443 | 3/1904 | St. Hilaire | 16/266 X |
| 959,560 | 5/1910 | Landis | 16/317 |
| 1,261,713 | 4/1918 | Crook | 16/266 |
| 1,294,044 | 2/1919 | Buckwalter et al. | 16/351 |
| 1,837,204 | 12/1931 | Chester | 16/343 |
| 3,398,487 | 8/1968 | Matayas | 16/312 X |

*Primary Examiner*—Fred Silverberg
*Attorney, Agent, or Firm*—Jackson & Jones

[57] ABSTRACT

A self closing lockable hinge system including a pin member and a sleeve member rotatable about the pin member. The pin member and the sleeve member have associated therewith mutually engageable surfaces such that upon rotation of one member relative to the other the sleeve member is movable from a lower closed position to an upper open position relative to the pin member. This movement is caused by engagement of the mutually engageable surfaces. There is also provided lock to retain the sleeve member in the lower closed position whereby in the closed position relative rotation between the pin member and the sleeve member is prevented. The lock comprises register means movable between a first aligned position whereby the movement of the sleeve member is permitted and a second misaligned position wherein the movement of the sleeve member is prevented.

10 Claims, 10 Drawing Figures

SELF-CLOSING CHILD-PROOF HINGE/LOCK MECHANISM

BACKGROUND OF THE INVENTION

1. Origin of the Invention

This is a continuation-in-part of application Ser. No. 508,154 filed on June 24, 1983, now abandoned.

2. Field of the Invention

The present invention is concerned with a hinge incorporating a locking mechanism and a self-closing mechanism for a door, gate or the like.

Of recent years, there has been a growing concern over the increasing incidence of child drownings, particularly in backyard swimming pools. As a consequence, many State Government and Local Government Authorities now require domestic swimming pools to be fenced and provided with an adequate locking means for access gates.

The present invention aims to provide a simple, inexpensive self-closing lockable hinge system for a gate, door or the like which obviates the need for a separate latch.

SUMMARY OF THE INVENTION

According to the invention there is provided a lockable hinge system comprising a pin member and a sleeve member rotatable about said pin member, said pin member and said sleeve member having associated therewith mutually engageable surfaces such that upon rotation of one of said members relative to the other said sleeve member is movable from a lower closed position to an upper open position relative to the pin member whereby said movement is caused by engagement of the mutually engageable surfaces; and locking means to retain said sleeve member in said lower closed position whereby in said closed position relative rotation between said pin member and said sleeve member is prevented, said locking means comprising register means movable between a first aligned position whereby said movement is permitted and a second misaligned position whereby said movement is prevented.

Preferably said register means comprises a slotted sleeve adapted for rotation about said pin member, said slotted sleeve being adapted in said first aligned position to slidably engage with a lateral projection on said pin member. In the misaligned position the lateral projection may engage an upper edge of the slotted sleeve.

The mutually engageable surfaces between the pin member and the sleeve member in one form may comprise complementary engageable cam surfaces or ramp surfaces. In another form there may be provided a lateral abutment of the pin member contacting a ramp or cam surface of the sleeve member or vice versa. In this latter embodiment the lateral abutment may have a continuous side or peripheral surface which contacts the ramp or cam surface.

There also may be provided a cap which may be fitted over the aforesaid slotted sleeve to conceal the engagement between the slot in the slotted sleeve and the lateral projection on the pin member.

BRIEF DESCRIPTION OF THE DRAWINGS

Various preferred embodiments of the invention will now be described with reference to the accompanying drawings in which.

DETAILED DESCRIPTION OF THE PREFERRED EMBODIMENT

Figure 1:
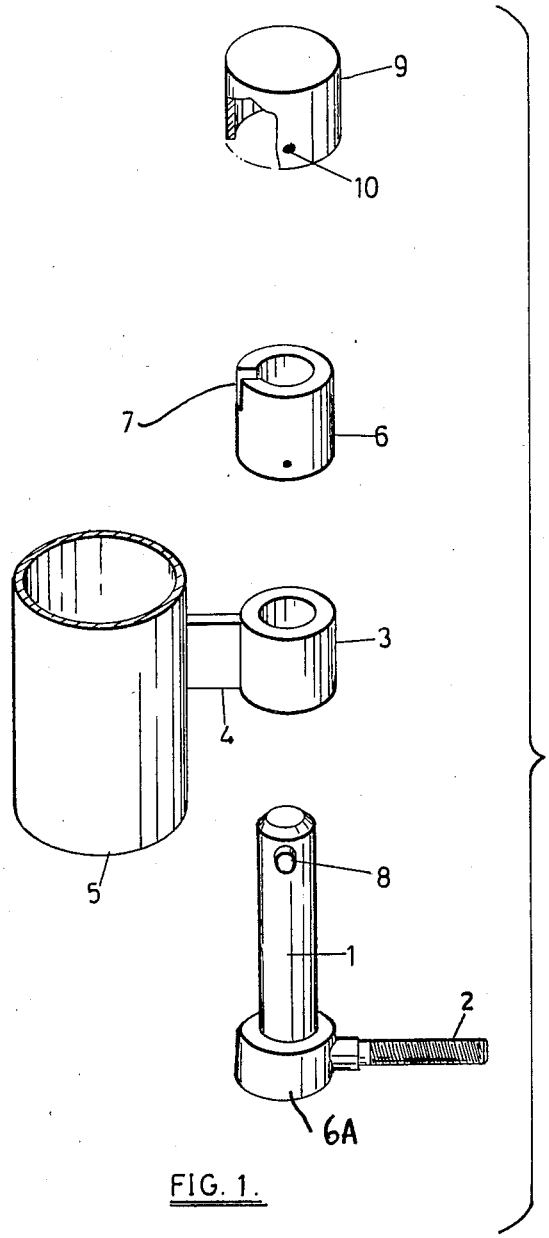
FIG. 1 illustrates an exploded view of a top hinge member for a safety gate.

In FIG. 1 the top hinge member comprises a hinge pin 1 adapted to be fitted to a gate post by threaded projection 2. A sleeve member 3 is adapted for rotational mounting on pin 1 and is provided with a strap or like member 4 for attachment to gate member 5 by any suitable means such as by welding, bolting, screwing etc.

A slotted sleeve 6 comprising a substantially cylindrical member with a slotted aperture 7 may rotate about hinge pin 1 between sleeve member 3 and a dowel pin 8 extending radially from hinge pin 1 adjacent the upper end thereof. With the aperture 7 in alignment with dowel pin 8, limited axial movement of sleeves 3 and 6 relative to abutment 6A of hinge pin 1 is possible and the extent of movement is limited by the depth of the slotted aperture 7. When aperture 7 and dowel pin 8 are misaligned, substantially no axial separating movement between the abutment 6A and the sleeve members is possible. A cover cap 9 is provided to fit neatly over sleeve 6 and is secured thereto by a grub screw 10.

Figure 2:
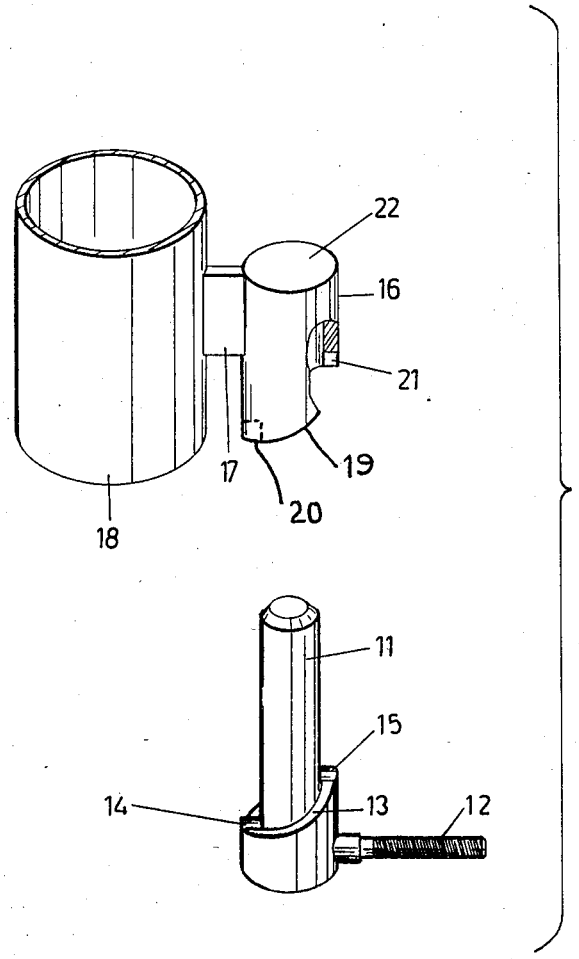
FIG. 2 illustrates an exploded view of a bottom hinge member for the gate, the top and bottom hinges together operatively comprising the hinge system according to the invention.

In FIG. 2 the lower hinge comprises a hinge pin 11 with a threaded projection 12 for attachment to a gate post (not shown). Formed about the lower end of hinge pin 11 is a ramped surface 13 and projections 14 and 15 extending axially from surface 13 on opposed sides of the pin at the lowest and highest positions respectively of the ramped surface 13. About pin 11 is fitted a substantially cylindrical sleeve 16 with a strap or like member 17 for attachment to gate member 18. The lower part of sleeve member 16 is shaped with a ramped surface 19. Apertures 20 and 21 are formed in the ramped surface 19 to correspond with projections 14 and 15 respectively. A cap 22 is formed on the top of sleeve member 16.

The operation of the hinge system of FIGS. 1 and 2 will now be described.

As will be readily evident, the mutually engageable surfaces of ramp surface 19 and projection 15 are aligned such that under the action of gravity, a gate, door or like member will swing to a normally closed position whereupon projections 14 and 15 will engage with corresponding apertures 20 and 21 respectively. In this position, opening of the gate by pushing or pulling will be prevented. In order to open the gate, the gate must first be lifted to disengage projections 14 and 15 from corresponding apertures 20 and 21 whereupon the gate may be swung in either direction with the engaging surfaces 15 and 19 engaging to further lift the gate as it is swung to a fully open position. On releasing the gate, it will swing under the action of gravity back to a central position locked by the engagement of projections 14 and 15 in apertures 20 and 21 respectively. Further locking for the gate is effected by rotating cap 9 on the top hinge to misalign slotted aperture 7 and dowel pin 8. With the further locking means thus engaged, it is not possible to lift the gate to disengage projections 14 and 15 from their respective corresponding apertures on the lower hinge and accordingly swinging of the gate in either direction is prevented.

Figure 3:
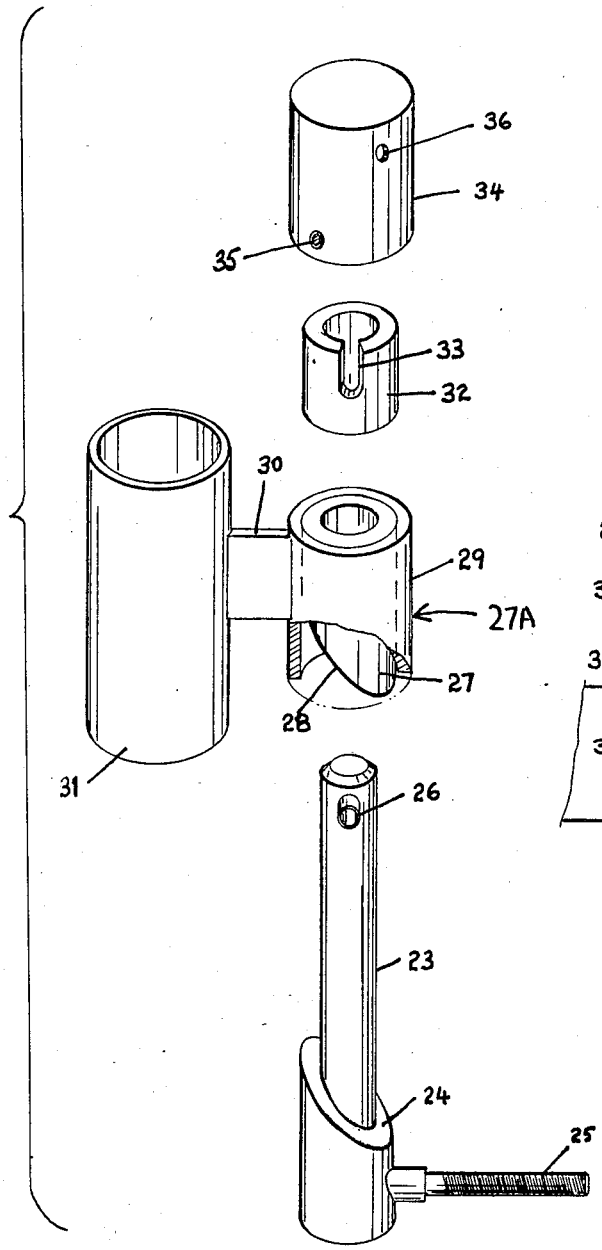
FIG. 3 illustrates an exploded view of a top hinge assembly constructed in accordance with the invention.

FIG. 3 illustrates an embodiment of the invention in which the ramped surfaces and the slotted sleeve locking means are combined in a single hinge element.

Hinge pin 23 is formed with a ramped surface 24 adjacent its lower end. A threaded projection 25 is provided for attachment to a gate post or the like. Adjacent the upper end of pin 23 is a hollow dowel pin 26 or the like. Pin 26 is preferably a friction fit in hinge pin 23 but it could otherwise be fixed by screw threaded engagement or the like.

A substantially cylindrical sleeve member 27A, with a ramp surface 28 complementary to ramped surface 24, is adapted for rotation about hinge pin 23. Ramped surface 28 may be formed integrally with outer sleeve 29 or as a sleeve insert 27 as shown. Outer sleeve 29 is attached to a mounting bracket 30 shown attached to portion of a tubular gate member 31.

A slotted sleeve 32, also adapted for rotation on hinge pin 23, is provided with a slot 33 which in use is adapted to engage dowel pin 26. A cap 34 is adapted to engage over sleeve 32 and may be firmly affixed thereto by a grub screw 35 or the like. An aperture 36 is provided in the wall of cap 34 for reasons explained below and also to provide access for lubrication purposes.

Figure 4:
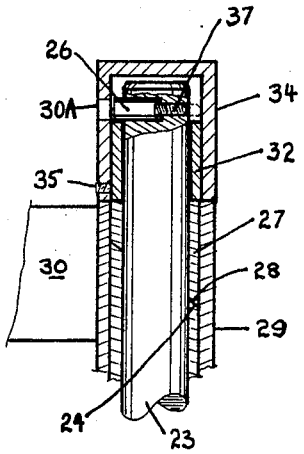
FIG. 4 illustrates a cross-sectional view of the assembly shown in FIG. 3.

FIG. 4 illustrates the various components shown in FIG. 3 in an assembled state. Further illustrated is a grub screw or the like 37 communicating at one end with the hollow aperture in dowel pin 26. As shown in phantom outline, grub screw 37 is insertable into the cavity 30A between the inner wall of cap 34 and the outer surface of hinge pin 23. The end of the grub screw 37 thus extends over the upper edge of slotted sleeve 32. This grub screw 37 provides additional locking means for the hinge assembly in that even when aperture 33 is aligned with pin 26 it is not possible to axially move or separate the components due to the engagement of one end of grub screw 37 with the top edge of slotted sleeve 32.

The operation of the hinge assembly is otherwise as described above except that an initial upward lift of the gate is not essential due to the absence of engaging projections and apertures on the ramped surfaces.

The single hinge element shown in FIGS. 3 and 4 adequately fulfils the objects of the invention but in hinging of a gate, door or the like it is common practice to employ an upper and lower hinge element to distribute load more evenly. In such an arrangement it would be preferable to employ an upper hinge comprising the assembly shown in FIGS. 3 and 4 and a lower hinge comprising a simple pin and sleeve or operatively equivalent hinge.

Figure 5:
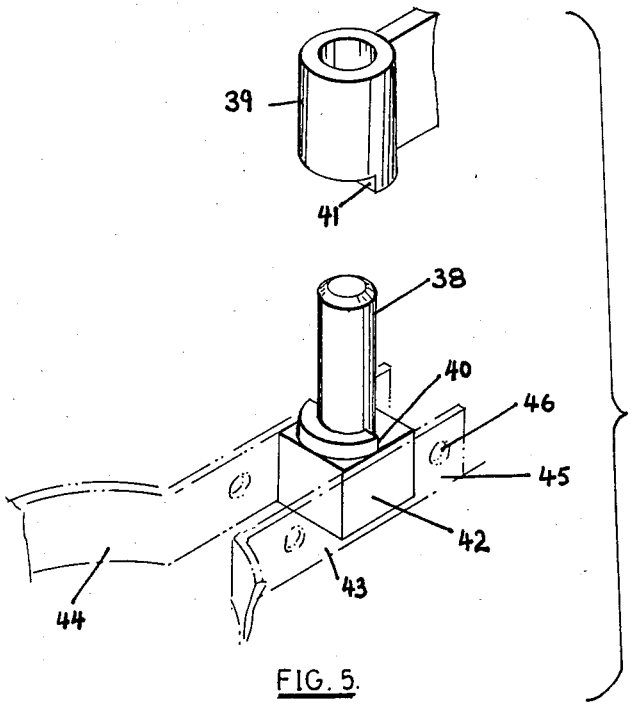
FIG. 5 illustrates a bottom hinge for use in combination with the top hinge assembly of FIG. 3.

FIG. 5 illustrates a modification suitable for use as a lower hinge. A pin 38 and a sleeve 39 are formed with complementary engagable surfaces 40 and 41 on complementary shoulder portions. Thus a hinge assembly comprising an upper hinge element as shown in FIGS. 3 and 4 and a lower hinge element as shown in FIG. 5 provides an even load distribution on the gate, door or the like and on the post or surface to which it is hinged. In operation, the gate must first be lifted to disengage surfaces 40 and 41 in a manner similar to the embodiment shown in FIGS. 1 and 2. Use of an additional locking means on the lower hinge element not only adds to the security and strength of a locked gate, door or the like but prevents damage to the upper hinge system if forced entry is attempted. Without the additional locking at the lower hinge, great compressive force may be applied between the upper edge of the slotted sleeve and the dowel pin which could cause burring.

Yet a further feature of the invention is illustrated in FIG. 5. The lower end of pin 38 is formed as a box-like base 42. In this manner, a variety of attachment means may be employed. For example, the base 42 may be drilled and/or tapped to receive a pin, bolt or the like or a mounting strap may be attached by welding. The base readily lends itself to universal-type mounting arrangements such as that shown in phantom. The bracket 43 includes a shaped portion 44 for attachment to say a circular cross-section gate member or gate post. Substantially parallel arms 45 are adapted to selectively locate and engage the base 40 under the compressive forces of bolts located in apertures 46.

It will be readily apparent that the hinge system of the present invention provides a very effective child-proof lock as not one, but two locking devices must be deactivated before the gate or door can be swung.

The present invention contemplates a hinge system, wherein one or more locking devices are comprised in a single hinge. For example, the hinge as illustrated in FIG. 2 could be formed with a longer hinge pin 11 to which a dowel pin 8 could be fitted adjacent the top to locate sleeve 6 and cap 9. Cap 22 on sleeve 16 would of course be omitted in this embodiment.

In any embodiment of the invention, it is preferred that the locking means comprising cap 9, sleeve 6 and dowel pin 8, be fitted to the top hinge of the gate out of reach of small children. Suitable markings could be made on the upper surface of cap 9 to indicate an unlocked position. In a further alternative embodiment, a key operated cylinder lock could be fitted to cap 9 or cap 34 to selectively permit rotation thereof.

Figure 6:
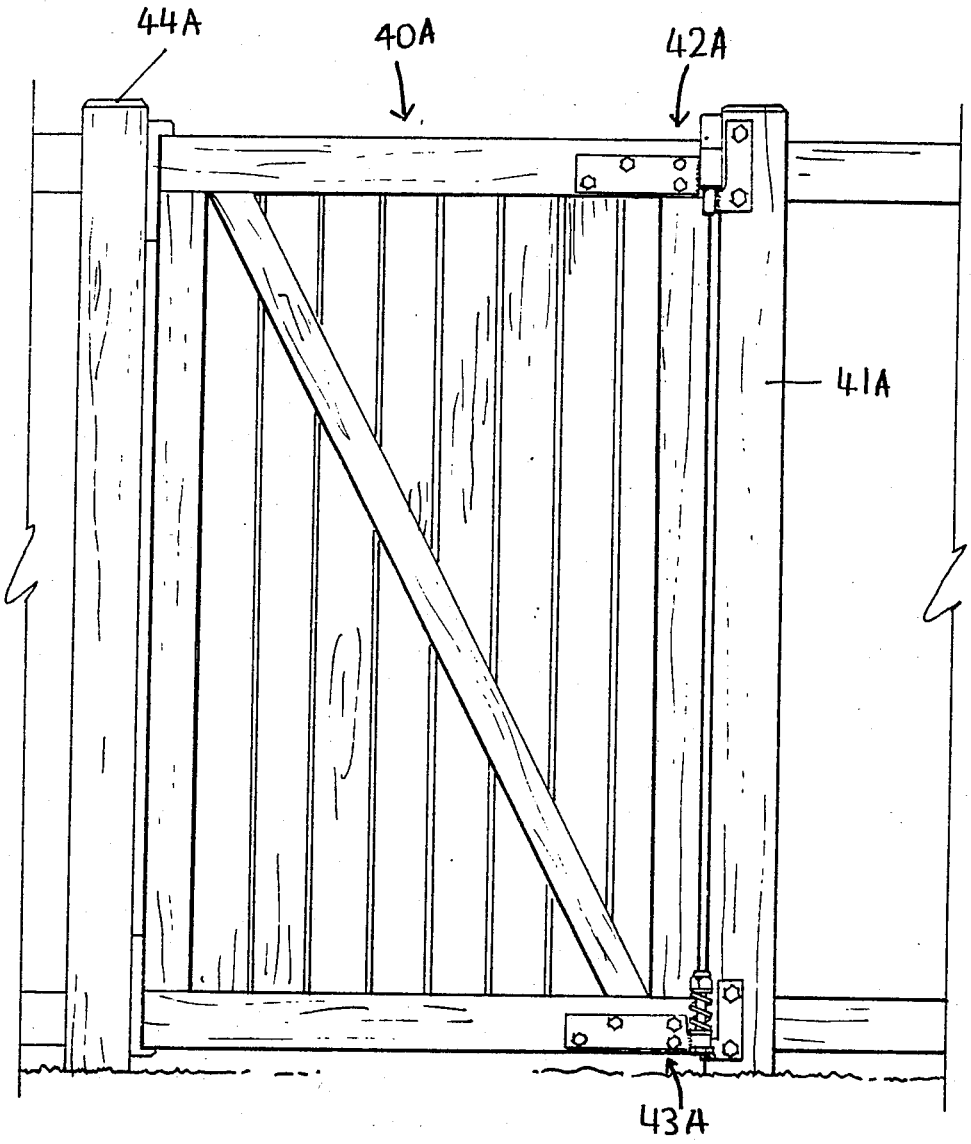
FIG. 6 is a view of a gate assembly having attached thereto a self closing hinge in accordance with the invention as well as an additional hinge provided with adjustable tensioning means.

The gate assembly shown in FIG. 6 includes gate 40A, gate post 41A, self closing hinge assembly 42A, and tensioning hinge assembly 43A. Gate 40A may be attached to gate post 44A by any suitable self locking or latching mechanism (not shown) which should be of a type that is not readily accessible to a child or toddler.

Figure 7:
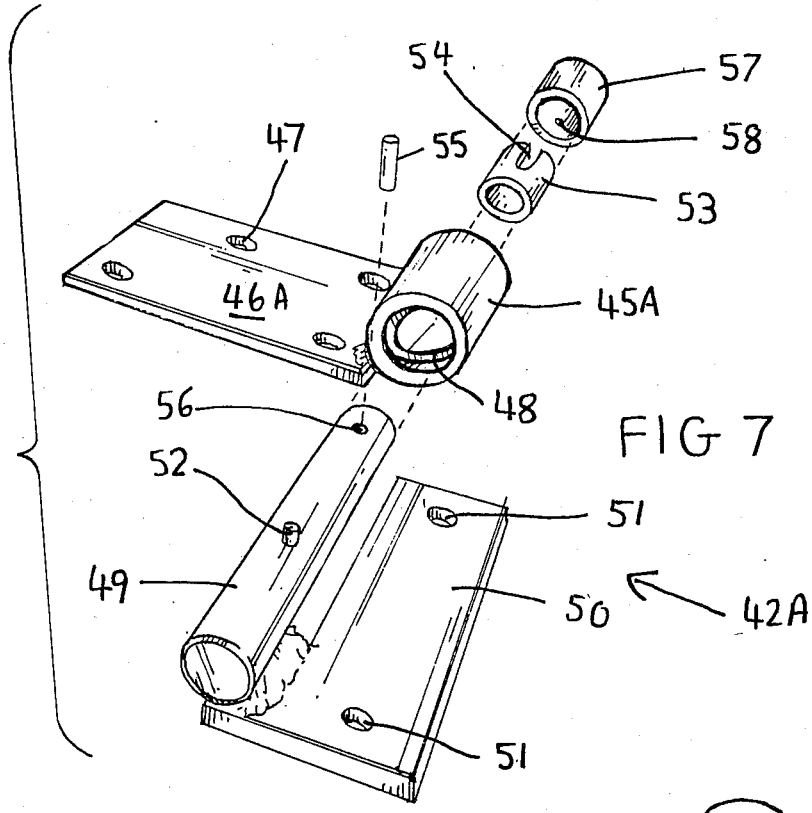
FIG. 7 is an exploded view of the self closing hinge shown in FIG. 6.
Figure 7A:
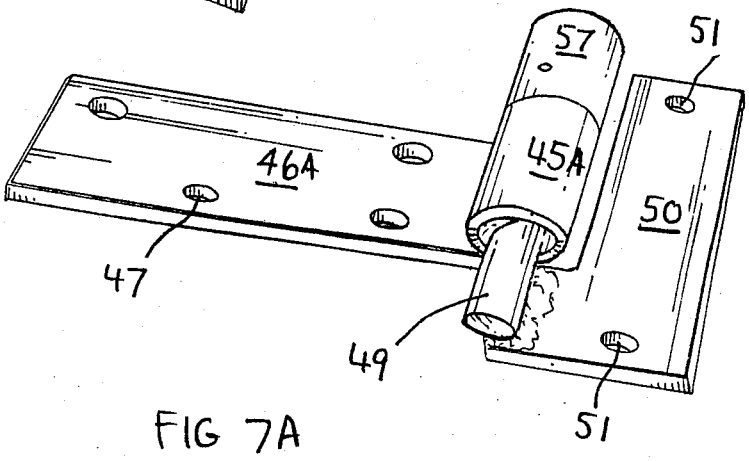
FIG. 7A is a perspective view of the assembled hinge.

In FIG. 7 there is shown self closing hinge assembly 42A which includes sleeve member 45A with attachment bracket 46A welded thereto having attachment apertures 47. Sleeve member 45A is also provided with an internal ramped surface 48. There is also shown pin member 49 having attachment bracket 50 welded thereto with associated attachment apertures 51. Pin member 49 has bearing projection 52 extending outwardly therefrom which may engage with ramped surface 48 to enable the sleeve member 45A to be elevated or lifted with regard to pin member 49 so that gate 40A may be swung in either direction so that the gate 40A is lifted to a maximum elevated position as it is pivoted to a fully open position. On releasing gate 40A it will pivot under the influence of gravity back to a closed position.

There is also shown slotted sleeve 53 which is also adapted for rotation on pin member 49 which is provided with a slot 54 which in use is engaged by detachable or separate pin 55 which is engagable in transverse bore 56. A cap 57 is adapted to engage over pin member 49 and may be provided with aperture 58 for attachment thereto by a grub screw (not shown). When slot 54 is in alignment with bore 56 limited axial movement of sleeve 53 relative to pin 49 is possible and the extent or limit of such movement is governed by the depth of the slot 54. When slot 54 and bore 56 are misaligned movement of sleeve 45A relative to the pin 49 is not possible. The cover cap 57 may be provided with an indicating mark (not shown) so as to show the degree of rotation necessary to align slot 54 with bore 56 to thus enable slotted sleeve 53 to be movable axially relative to pin 49 and thus enable sleeve 45A to be lifted on pin 49 to thereby enable the gate 40A to pivot in either direction. Further rotation of sleeve 53 relative to pin 49 to achieve a misaligned position between slot 54 and bore 56 may retain sleeve 45A in a locked position relative to pin 49. When slot 54 and bore 56 are in an aligned position it is also possible to dismantle hinge assembly 42A by removal of pin 55.

Figure 8:
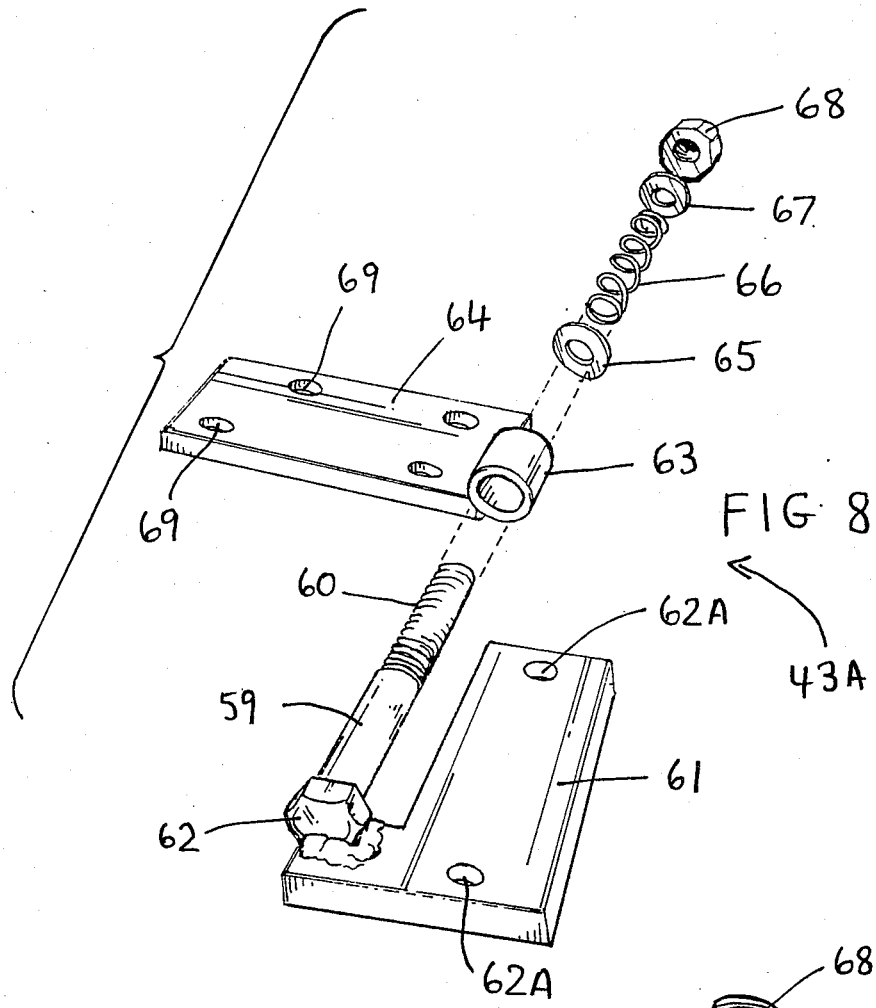
FIG. 8 is an exploded view of the tensioning hinge of FIG. 6.
Figure 9:
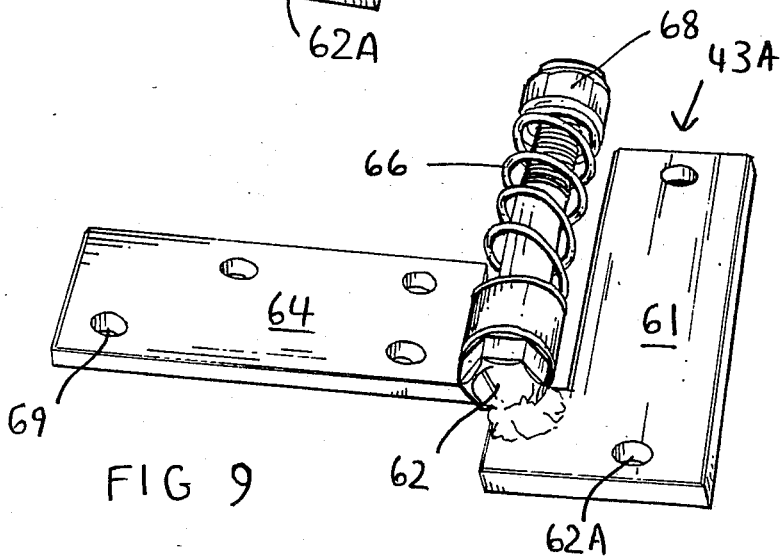
FIG. 9 is an assembled view of the hinge shown in FIG. 8.

In FIGS. 8–9 there is shown a suitable lower hinge member 43A comprising a stem 59 having a screw threaded portion 60 and attachment bracket 61 welded thereto and head portion or abutment 62. Attachment bracket 61 has attachment apertures 62A. There is also shown tube or sleeve member 63 with attachment bracket 64 welded thereto. Located on threaded portion 60 of stem 59 are washer 65, spring 66, washer 67 and threaded retaining nut 68. The degree of tension of spring 66 will regulate or control the restoring force necessary to close gate 40A relative to gate post 41. There is also shown attachment apertures 69 for bracket 64.

It will be appreciated that in a variation of the foregoing sleeve member 45A could have been provided with a bearing projection extending outwardly from an internal surface thereof which may engage with a ramped surface located on the external surface of pin 49 to function in much the same manner as the illustrated embodiment.

Although the invention has been described with reference to safety gates, it is equally applicable to other items such as safety screen doors, medicine cupboard doors, house gates etc.

The hinge system according to the invention would be most beneficial in a rural environment for use on stock gates and the like where self-closing and self-locking (by the first lock means at least) features would prevent stock from straying.

It will be readily apparent that many modifications may be made to the hinge system without departing from the spirit and scope of the invention.

I claim:

1. A self-closing lockable hinge system including:

a pin member having a longitudinal axis and a sleeve member rotatable about said pin member, said pin member and said sleeve member having associated therewith mutually engagable surfaces such that upon rotation of one of said members relative to the other, said sleeve member, as a result of the engagement of said mutually engagable surfaces, is axially movable along said longitudinal axis of said pin member from a lower closed position to an upper open position relative to the pin member;

a stop located on the pin member and spaced away from said sleeve member;

a register means surrounding the pin member between the stop and the sleeve member and fixably and manually rotatable about said pin member for alignment with said stop, said register means being alignable to a first position wherein said axial movement of said sleeve along said pin's longitudinal axis is permitted and alignable to a second position wherein said axial movement of said sleeve along said pin's longitudnal axis is prevented.

2. A hinge system as claimed in claim 1 wherein said stop is a lateral abutment on said pin member and said register means comprises a slotted sleeve adapted for rotation about said pin member, said slotted sleeve being adapted in said first position to slidably engage with said abutment on said pin member so as to permit relative axial movement between said pin member and said sleeve member.

3. A hinge system as claimed in claim 1 wherein said mutually engageable surfaces are formed by co-operating cam surfaces of said pin member and said sleeve member.

4. A hinge system as claimed in claim 1 wherein said mutually engageable surfaces are formed by a cam surface associated with the sleeve member and a lateral projection of the pin member.

5. A hinge as claimed in claim 1 wherein said pin member is provided with attachment means for attachment to a gate post and said sleeve member is provided with attachment means for attachment to a gate member.

6. A combined self-closing and manually lockable hinge/lock system which is essentially child proof in that no visible or easily removable locking member is readily available to young children, said system comprising:

a hinge having in one part thereof a pin member having a lateral projection extending from a lower part and a lateral abutment extending from an upper part;

a sleeve member located above the lateral projection, said sleeve member surrounding and being rotatable about the pin member and having a downwardly facing ramped cam surface engagable with the lateral projection whereby on said engagement said sleeve member may move from a lower closed position to an upper open position relative to the pin member;

locking means located between the top of the sleeve member and said lateral abutment and having a slotted register sleeve with the slot depnding downwardly from an upper edge of said register sleeve and being of a dimension to accomodate the lateral abutment of said pin member in said slot and further being rotatable to aid lower closed position wherein said slot is not aligned with the lateral abutment for preventing movement of said sleeve member when in said closed position and for attaining, in response to manual rotation of said register sleeve, a position wherein said slot is aligned with said lateral abutment for permitting movement of said sleeve member to occur; and a cap covering the slotted register sleeve and connected thereto for hiding from view the locking means while still permitting rotation of said register sleeve.

7. A combined self-closing and manually lockable hinge/lock system which is essentially child proof in that no visible or easily removable locking member is readily avaiable to young children, said system comprising a hinge having in one part thereof a pin member projecting above a primary engagement surface and a lateral abutment extending from an upper part;

a sleeve member located above the lateral abutment, said sleeve member surrounding and being rotatable about the pin member and having a secondary engagement surface engageable with the primary engagement surface whereby on said engagement said sleeve member may move from a lower closed position to an upper open position relative to the pin member;

locking means located between the top of the sleeve member and said lateral abutment and having a slotted register sleeve with the slot depending downwardly from an upper edge of said register sleeve and being of a dimension to accommodate the lateral abutment of said pin member in said slot and further being rotatable to said closed position wherein said slot is not aligned with the lateral abutment for preventing movement of said sleeve member when in said closed position and, in response to manual rotation of the register sleeve to attain a position wherein said slot is aligned with said lateral abutment, for permitting said movement to occur; and a cap covering the slotted register sleeve and connected thereto for hiding from view the locking means while still permitting rotation of said register sleeve.

8. A combined self-closing and manually lockable hinge/lock system as claimed in claim 7 wherein the primary engagement surface comprises an upwardly inclined ramped cam surface and the secondary engagement surface comprises a downwardly inclined ramped cam surface.

9. A combined self closing and manually lockable hinge/lock system as claimed in claim 7 wherein the primary engagement surface comprises a lateral projection and the secondary engagement surface comprises a ramped cam surface.

10. A combined self-closing and manually lockable hinge/lock system comprising a hinge having a pin member projecting above a primary engagement surface and a lateral abutment extending from an upper part;

a sleeve member located above the lateral abutment, said sleeve member surrounding and being rotatable about the pin member and having a secondary engagement surface engageable with the primary engagement surface whereby on said engagement said sleeve member may move from a lower closed position to an upper open position relative to the pin member;

locking means located between the top of the sleeve member and said lateral abutment and having a slotted register sleeve with the slot depending downwardly from an upper edge of said register sleeve and being of a dimension to accommodate the lateral abutment of said pin member in said slot and further being rotatable to said closed position wherein said slot is not aligned with the lateral abutment for preventing movement of said sleeve member when in said closed position and in response to manual rotation of the register sleeve to attain a position wherein said slot is aligned with said lateral abutment, for permitting said movement to occur.

* * * * *